United States Patent [19]

Buisson et al.

[11] Patent Number: 4,708,237

[45] Date of Patent: Nov. 24, 1987

[54] PROCESS AND DEVICE FOR SUPPLYING AN OPERATION STATION WITH A SUCCESSION OF GUIDED ARTICLES

[75] Inventors: Claude Buisson, Ocioet; Jean-Alain Delafoy, Fleury les Aubrais, both of France

[73] Assignee: Societe Nationale d'Exploitation Industrielle des Tabacs et Allumettes, France

[21] Appl. No.: 717,453

[22] Filed: Mar. 29, 1985

[30] Foreign Application Priority Data

Apr. 2, 1984 [FR] France ..... 84 05273

[51] Int. Cl.[4] ..... B65G 19/00

[52] U.S. Cl. ..... 198/726; 198/504; 198/575

[58] Field of Search ..... 198/504, 627, 726, 463.6, 198/464.3, 718, 572, 575, 577, 748, 461, 345, 468.9, 468.10, 473.1

[56] References Cited

U.S. PATENT DOCUMENTS

| | | | |
|---|---|---|---|
| 2,834,388 | 5/1958 | Meyer | 198/504 |
| 3,938,650 | 2/1976 | Holt | 198/461 |
| 4,073,375 | 2/1978 | Hart et al. | 198/464.3 |
| 4,116,324 | 9/1978 | Burmeister | 198/748 |
| 4,240,540 | 12/1980 | Hobbs et al. | 198/463.6 |
| 4,508,210 | 4/1985 | Ramcke et al. | 198/627 |
| 4,538,694 | 9/1985 | Hudson | 198/504 X |

FOREIGN PATENT DOCUMENTS

| | | |
|---|---|---|
| 556988 | 7/1932 | Fed. Rep. of Germany . |
| 1352304 | 1/1964 | France . |
| 2237820 | 2/1975 | France . |
| 2430731 | 2/1980 | France . |
| 2493683 | 5/1982 | France . |
| 595783 | 2/1978 | Switzerland . |

*Primary Examiner*—Robert J. Spar
*Assistant Examiner*—Jonathan D. Holmes
*Attorney, Agent, or Firm*—Jacobs & Jacobs

[57] ABSTRACT

A process and device are provided for supplying an operation station with a succession of articles guided along a given path from a feeding station, whereby an acceleration is imparted to each article by a pushing lug for example, and then the article is braked by a retainer lug for example.

5 Claims, 5 Drawing Figures

PROCESS AND DEVICE FOR SUPPLYING AN OPERATION STATION WITH A SUCCESSION OF GUIDED ARTICLES

BACKGROUND OF THE INVENTION

The present invention relates first of all to a process for supplying an operation station with a succession of articles guided along a defined path and for removing said articles from said operation station along a similar path, in which, in a first phase, an acceleration is communicated to each article.

It also relates to a device for implementing this process.

This invention may be used in all industries in which it is required to control rapidly a batch of articles of small dimensions, in particular fragile articles, in which an operation station allows at least one characteristic of each article for example to be identified or measured for rapid sorting thereof, for example.

It has a great interest in the industry for manufacturing smokers articles, mainly for measuring the characteristics of filters, rolls of tobacco, cigarettes, cigars.

In this kind of industry, difficulties are met with in handling the articles at high speed without losing the required accuracy for checking the weight for example. It often happens that it is desirable to use the same apparatus for measuring the characteristics of articles of the same general shape but having important variations in their geometrical characteristics. In particular, in the tobbaco industry, the length of the articles may be modified considerably.

One of the aims of the invention is to provide a device for supplying an operation station for example for identifying or measuring at least one characteristic of a batch of similar articles following a defined path, for example substantially rectilinear and for removing said articles from said station following a similar path, at a very high rate and with the minimum of shocks during handling.

Another aim of the invention is to provide a simple and inexpensive device capable of being adapted or automatically adapting itself to an appreciable variation in the dimension of the article in the direction in which this article travels through the device.

Another aim of the invention is to be able to rapidly or automatically modify the positioning of the article in the measuring or identification station depending on the characteristics of the article, for example its length, the distribution of its mass.

SUMMARY OF THE INVENTION

For this, the invention provides first of all a process for supplying an operation station with a succession of articles guided along a defined path and for removing said articles from said operation station along a similar path, in which, in a first phase, an acceleration is communicated to each article, and, in a second phase, said article is braked so that it stops in said operation station, while removing the preceding article from said operation station.

Thus the acceleration communicated in the first phase may be considerable in order to increase the feed rate of the operation station without the article being damaged on arriving in the operation station. The invention also provides a device for implementing this process, comprising an article feeding station, an operation station and a discharge station, guide means disposed between the feeding station and the operation station, and first means movable in translation along said guide means for pushing each article, which device further comprises second means movable in translation along said guide means for retaining each article to cause it to stop in the operation station, after it has been pushed by the first means and for discharging the preceding article from said operation station.

The contacts between each article and the first and second means are thus very much reduced and fragile articles are not damaged.

Advantageously, the first and second means are lugs fixed to two endless belts, adapted so that one lug, after pushing an article, retains the following article so that each lug alternately fulfils the function of said first and second means.

Thus, the feed rate of the operation station may be further increased.

BRIEF DESCRIPTION OF THE DRAWINGS

The invention will be better understood from the detailed description of one embodiment, more particularly adapted for the rapid weighing of cigarettes and given by way of non limitative example.

DESCRIPTION OF THE PREFERRED EMBODIMENT

Figure 1:
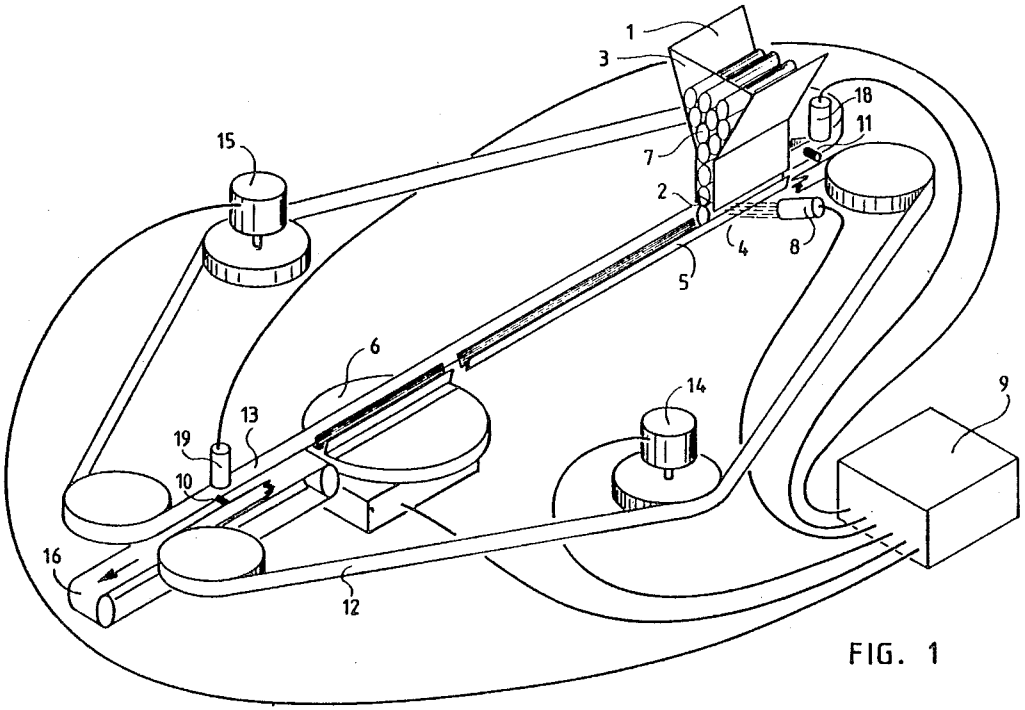
FIG. 1 is a schematical general view of the device.

In FIG. 1 a hopper 1 can be seen which is intended to receive a reserve of articles to be measured, for example cigarettes and which has an opening 2 at its lower end for successively delivering said articles one by one in a way known per se.

These articles positioned by bottom 3 of the hopper are presented to the feeding station 4. The device may comprise a means 8 for detecting the length and/or the exact position of article 7 to be transferred, for example a set of cells which may inform in a way known per se the schematically represented microprocessor 9 which drives the device.

This station 4 comprises as guide means 5 a V which extends as far as the operation station 6. This device may be further equipped with a means allowing the microprocessor to modify the position of the article in the measuring station. In this particular non limitative example, the characteristics of distribution of the masses will be indicated manually to the processor provided with a program constructed in a way known per se so as to determine the center of gravity of the article to be weighed and to transfer it to a position in the operation station for weighing under optimum conditions of accuracy.

The device further comprises two assemblies of means having at least one lug, respectively 10 and 11, of a shape adapted to the article to be transferred, said lug being fixed to a belt or band respectively 12 and 13 moving at least between the feeding and discharge stations along a substantially rectangular path. In a preferred embodiment of the invention, this endless belt is placed in a preferably horizontal plane and is driven by a stepper motor, respectively 14 and 15, itself controlled by the microprocessor according to a programmed law of movement as a function of the positions of the lug along the path, as explained further on.

The operation station 6 is in the example described an electronic weighing machine in which the pan of the mobile assembly is tangent to the path of the articles.

A detection means 18, respectively 19, signals to the processor 9 the initial position of lugs 10, respectively 11.

The discharge station 16, is in this case, a belt driven at a speed higher than the speed at which the articles are discharged from the weighing machine.

For the sake of simplicity of the drawings in FIGS. 2, 3, 4, 5, motors 14 and 15 have been shown in another position than that shown in FIG. 1.

Figure 2:
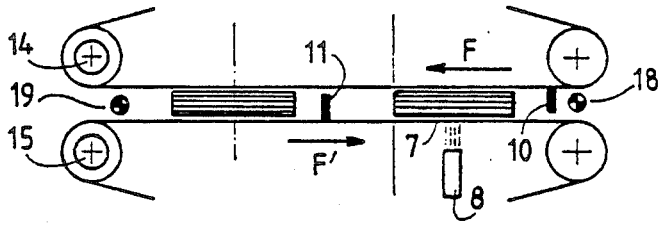
FIGS. 2, 3, 4, 5 are explanatory diagrams of the transfer corresponding respectively to phases I, II, III, IV explained hereafter.

FIG. 2 shows phase I of operation of the device. An article 7 is fed by the hopper 1 (not shown) to the feeding station 4. The processor 9 (not shown) depending on the information supplied by detectors 8 and 18, controls motor 14 so as to bring lug 10 into pressureless contact with the article. At the end of the preceding cycle or at latest at the same time depending on the indication supplied by detectors 8 and 19, it controls motor 15 so as to bring lug 11 in pressureless contact with article 7. The direction of movement of lugs 10 and 11 is symbolized respectively by arrows F and F′ in each FIG. 2 to 5.

Figure 3:
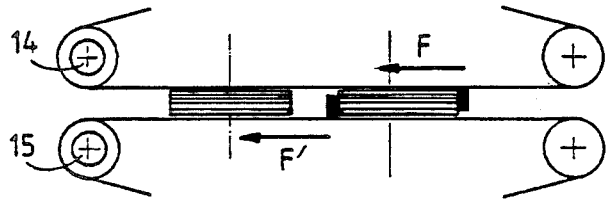

FIG. 3 shows phase II of movement from the feeding station to the measuring station.

During this phase, the processor 9 controls motors 14 and 15 in synchronism according to a law of movement determined by the program so as to reduce the transfer time as much as possible without excessive harshness for the article transported. For example, the article is accelerated for a part of the travel, over another part it travels at a steady speed, then is decelerated so as to arrive in the measuring station at a very low speed compatible with the fragility of the article transported.

Figure 4:
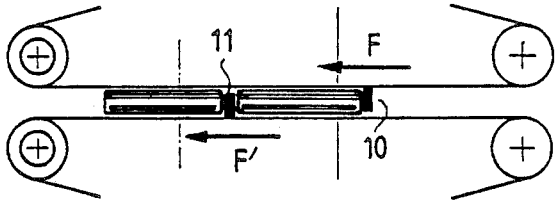

FIG. 4 shows phase III of movement. Lug 11 which served as a stop for the transported article becomes a pusher for the preceding article which it discharges then to the next station.

Figure 5:
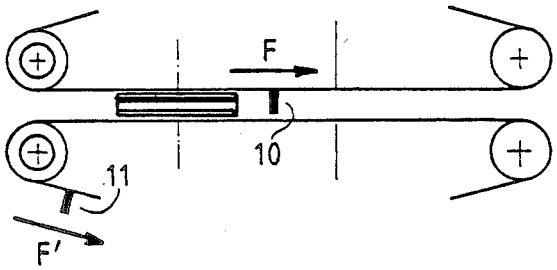

FIG. 5 shows measuring phase IV. Lugs 10 and 11 assume respectively the initial positions but reversed of phase I. During this time, since the article is released in the measuring station, it may be weighed all the more rapidly since the transport took place without shocks.

Still within the scope of the invention, the belts may be equipped with a larger number of lugs so as to limit the initialization travel distances, each lug then becoming successively an active lug (pusher or stop).

Still within the scope of the invention, this device may be integrated with a device for sorting out articles as a function of the characteristics measured in the operation station 6, in this case a measuring station, replacing the discharge station 16 by a sorting station.

What is claimed is:

1. A device for supplying an operation station with a succession of articles, comprising an article feeding station, an operation station, and a discharge station, guide means disposed between the feeding station and the operation station, first means movable in translation along said guide means for pushing each article, and second means movable in translation along said guide means for braking each article pushed by said first means so that the article stops at the operation station, and for discharging the preceding article from said operation station, wherein said first and second means comprise first and second lugs fixed to first and second endless belts, said belts being operable in a first cycle to push said article with said first lug, to brake said article with said second lug and to discharge the preceding article with said second lug, said belts being operable in a second cycle to push said article with said second lug, to brake said article with said first lug and to discharge the preceding article with said first lug, and control means for alternately operating said belts in each said cycle.

2. The device as claimed in claim 1, wherein said control means comprises position sensors, disposed in the path of the articles and of the lugs, connected to the inputs of a microprocessor and wherein two motors for driving said belts are connected to the outputs of said microprocessor.

3. The device as claimed in claim 2, wherein said position sensors are optoelectronic sensors.

4. The device as claimed in claim 2, wherein said drive motors are stepper motors.

5. The device as claimed in claim 1, wherein said operation station is a weighing station.

* * * * *